United States Patent [19]

Shah et al.

[11] 4,297,072

[45] Oct. 27, 1981

[54] MANWAY HANDLING APPARATUS

[75] Inventors: Siddharth A. Shah, South Portland; Sidney J. Woodcock, Scarborough; Robert D. Fagan, Cape Elizabeth, all of Me.

[73] Assignee: General Electric Company, Schenectady, N.Y.

[21] Appl. No.: 83,280

[22] Filed: Oct. 10, 1979

[51] Int. Cl.[3] ..... B66C 23/06

[52] U.S. Cl. ..... 414/684.3; 414/630; 212/166

[58] Field of Search ..... 254/120, 130, 133 R; 414/164, 680, 744 R, 751, 753, 776, 783, 591, 633, 684.3, 909; 212/166, 226, 251

[56] References Cited

U.S. PATENT DOCUMENTS

| | | | |
|---|---|---|---|
| 14,838 | 5/1856 | Green et al. | 212/226 |
| 1,190,036 | 7/1916 | Stauft | 212/166 |
| 2,667,276 | 1/1954 | Peterson | 212/166 |
| 3,212,649 | 10/1965 | Johnson et al. | 414/744 |
| 3,503,293 | 3/1970 | Sander | 414/744 R |
| 4,206,848 | 6/1980 | Weisse et al. | 212/166 |

FOREIGN PATENT DOCUMENTS

| | | | |
|---|---|---|---|
| 1385747 | 1/1964 | France | 414/164 |

*Primary Examiner*—Lawrence J. Oresky
*Attorney, Agent, or Firm*—John F. Ahern; Ormand R. Austin

[57] ABSTRACT

A manway handling apparatus for handling heavy sealing manways in large shells without damaging sealing surface means therefor is provided which includes a support arm pivotally mountable on equipment having elliptical manway access openings. The support arm when mounted is swingable toward and away from an access opening and carries a bearing block supporting bracket which is longitudinal adjustably positionable on the arm. A bearing block is vertically adjustably positionable in the bracket and slidably supports a shaft which is attachable to an elliptical cover. Structure is provided for longitudinally actuating and rotating the shaft to position and rotate the cover to facilitate installation and removal of the cover through the elliptical opening. The shaft carries structure means which when actuated by turning of a crank handle is effective for tilting the cover also to facilitate its installation and removal. Releasable locking structure enables an operator to secure the shaft and rotating structure relative to the supporting structure.

11 Claims, 6 Drawing Figures

MANWAY HANDLING APPARATUS

BACKGROUND OF THE INVENTION

The present invention relates to equipment utilizing heavy manway or access covers and, more particularly, to apparatus for facilitating the installation and removal of such covers having an elliptical or other non-circular configuration.

Moisture separator reheaters and the like are examples of equipment which employ manway openings to enable access to the interiors of such equipment. Generally moisture separator reheaters include an outer shell with a manway opening and an internal header with an elliptical manway about which is mounted a sealing ring. Additionally, a standard industry practice has been to provide a gasket on the internal surface of the manway sealing ring and an elliptical cover which closes the manway in the header from the inside in order thereby to obtain the advantage of internal pressure to effect satisfactory sealing of the manway opening. Such earlier covers usually were hinged from inside the header. However, hinged manway covers often do not align properly to locate the gasket due to slack in the hinges. This can result in leakage during operation with resultant adverse effects on performance of the equipment and the necessity of replacing or repairing the gasket. Furthermore, manway covers are generally large, heavy and cumbersome to handle and with the prior type of arrangement a crane or hydraulic apparatus is required to mount the cover on its hinge. Still further, in some equipment, such as ones in which the headers contain tube bundles, the space in the headers is limited and insufficient to accommodate internally swinging covers.

OBJECTS OF THE INVENTION

It is an object of the present invention to provide new and improved apparatus for handling heavy cumbersome manway covers.

Another object of the present invention is to provide new and improved apparatus whereby manway covers can be internally positioned in a header without reliance on hinges and the use of cranes or hydraulic apparatus.

Another object of the present invention is to provide new and improved apparatus for installing and removing elliptical manway covers and which is particularly effective in locating and aligning the covers with respect to gaskets located on the internal sealing surfaces of the manway sealing rings.

Still another object of the present invention is to provide manway cover handling apparatus which is easily operatable and is readily usable in a manner to minimize any possible damage to machined surfaces, as on cooperating sealing rings, during installation and removal of manway covers.

SUMMARY OF THE INVENTION

The objects of the invention are achieved by manway cover handling apparatus including a horizontal support arm having one end pivotally mountable on the shell of the equipment to one side of a manway opening in the shell into which access is gained and which has an elliptical manway opening therein. A vertical slide bracket is carried by the arm and is laterally adjustably positionable along the arm. A bearing block is carried by and vertically adjustably positionable on the slide bracket. A linear bearing containing a tubular shaft is contained in the bearing block. The tubular shaft is slidably and rotationally actuatable in the linear bearing, and the inner end of the shaft is apertured for being pivotally connected to a lug at the center of the outer side of an elliptical manway cover. The outer end of the tubular shaft carries a doubleended lever handle whereby the shaft and the cover pivotally attached to the end thereof may be both actuated toward and away from an access opening and rotated. Rotatably mounted in the tubular shaft is an externally threaded rod which carries an internally threaded member. The internally threaded member is housed in the shaft and includes a portion which extends through a longitudinal slot in the tubular shaft and is pivotally connected by means of a pivotal linkage to the manway cover adjacent the rim thereof. A crank handle is fitted on the outer end of the threaded rod so that the rod may be manually rotated clockwise or counterclockwise to cause the internally threaded member to be actuated longitudinally toward or away from the inner end of the tubular shaft, and the manway cover may be rotated or tilted about the point of its pivotal connection to the end of the tubular shaft. A shaft lock is carried by the bearing block which, when effectively positioned, locks the hollow shaft, the rod therein and the bearing block as a unitary structure to, for example, facilitate the connection of the manway cover to the apparatus in preparation for employing the apparatus in installing the cover in the header.

DESCRIPTION OF THE DRAWING

The above and other objects and features of the invention will be better understood by reference to the following detailed description taken in connection with the accompanying drawing in which.

DETAILED DESCRIPTION OF THE INVENTION

Figure 1:
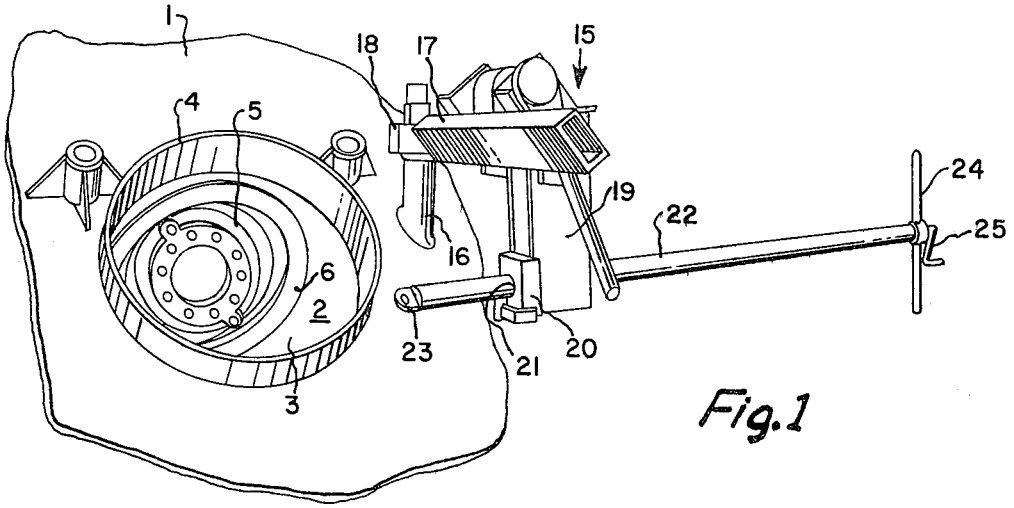
FIG. 1 is a perspective view of an embodiment of the manway cover handling apparatus illustrating generally several major features thereof and the construction of the equipment with which it is adapted for use.
Figure 2:
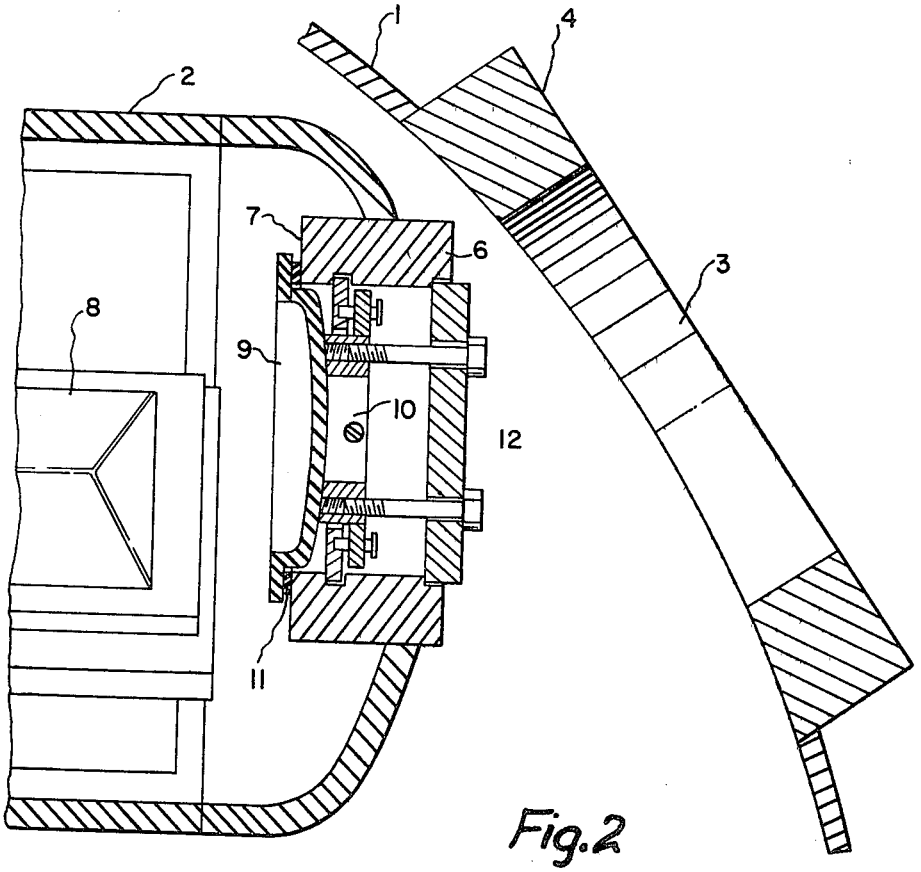
FIG. 2 is a fragmentary sectional view illustrating the relationship of the manway openings in the equipment shell and header and the manner in which a manway cover is held in sealed position after it is placed in the header.

Referring to FIGS. 1 and 2, a moisture separator reheater which is an example of equipment with which the present invention is particularly useful, generally comprises an outer shell 1 and a header 2 disposed within the shell. The shell 1 includes a circular manway or acces opening 3 which is surrounded by a rim 4. Header 2 includes an elliptical manway or access opening 5 in which is mounted an elliptical sealing ring 6 having an internal machined sealing surface 7. A tube bundle 8 which is part of the heat exchanger portion of the moisture separator reheater (MSR) is in fluid flow relationship with header 2 and extends within shell 1 away from the area of manway 3.

The manway opening 5 in the header is adapted for being closed and sealed by an elliptical manway cover 9 shown in FIG. 2 and having an apertured lug 10. The cover 9 is adapted for being positioned internally of the header 2 and being removably held in sealing contact with the sealing surface 7 on the sealing ring 6 with the use of an interposed sealing gasket 11 and a suitable clamping arrangement generally designated at 12.

The elliptical configuration of the sealing ring 7 and of the cover 9, together with the weight of the cover, the internal disposition thereof in the limited space within the header and the necessity of avoiding damage to the sealing surface 7 and other adjacent parts necessitates use of special handling means for installing the cover 9 in the manway sealing position illustrated in FIG. 2. The present invention constitutes such a handling means and is illustrated in one of its embodiments in FIG. 1 wherein the apparatus is generally designated at 15 and is pivotally mounted at one end on a vertical pivot post 16 welded to the shell 1 on the right side of a manway 2 therein.

The handling apparatus 15 comprises several basic components including a horizontally extending support arm 17 having a journal 18 at one end fitted on the pivot post 16, a vertical slide bracket 19 carrying a bearing block 20 housing a linear bearing 21, and a tubular shaft 22 slidably and rotatably fitted in the linear bearing. The shaft carries a connector 23 at its inner end for being suitably removably coupled to the apertured lug 10 of the cover. Additionally, the opposite or outer end of the shaft is fitted with a double-ended lever handle 24 to enable longitudinal actuation and rotation of the tubular shaft and a manway cover connected thereto along and about a horizontal axis. Rotatably mounted in the tubular shaft but not seen in FIG. 1 is a threaded rod to the outer end of which is fitted a crank handle 25. The threaded rod and crank handle comprise parts of another mechanism which is more fully described hereinafter in connection with the second illustrated embodiment and which is provided to effect rotation or tilting of a manway cover about an axis extending normal to the axis of the tubular shaft. The pivotal movement of the horizontal support arm 17 and the capability of the described apparatus for rotating an attached manway cover about a pair of axes enable an operator relatively easily to maneuver an elliptical manway cover into the elliptical manway opening in the header and to position it for being readily installed in effective sealing relation with the sealing rim about the manway opening. The specific means for accomplishing this and other means included in the apparatus for enabling adjustments thereto better to ensure ease and effectiveness of operation of the apparatus, as well as precision in effecting the seal, are brought out more fully in FIGS. 3–6 illustrating a second embodiment and are described in greater detail hereinafter.

Figure 3:
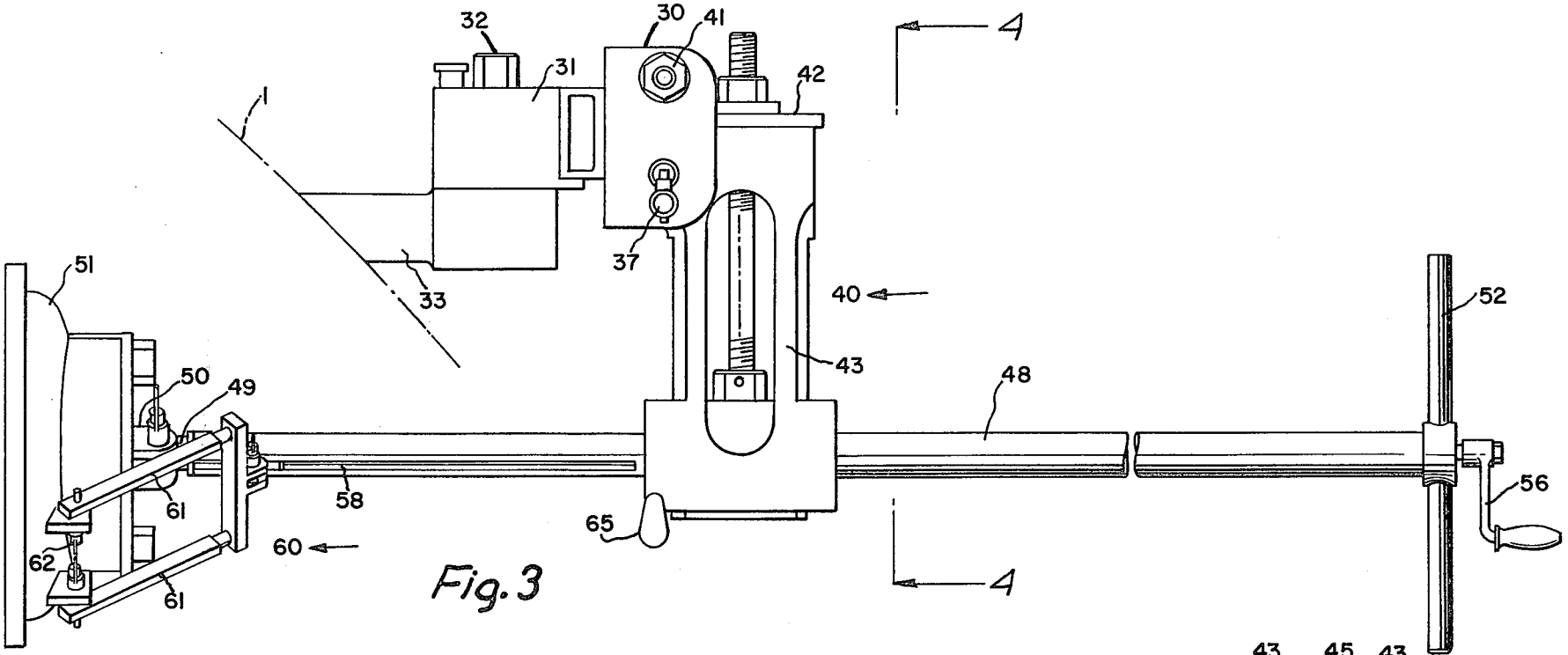
FIG. 3 is a side view of a second embodiment of the manway cover handling apparatus showing a manway cover attached thereto.
Figure 4:
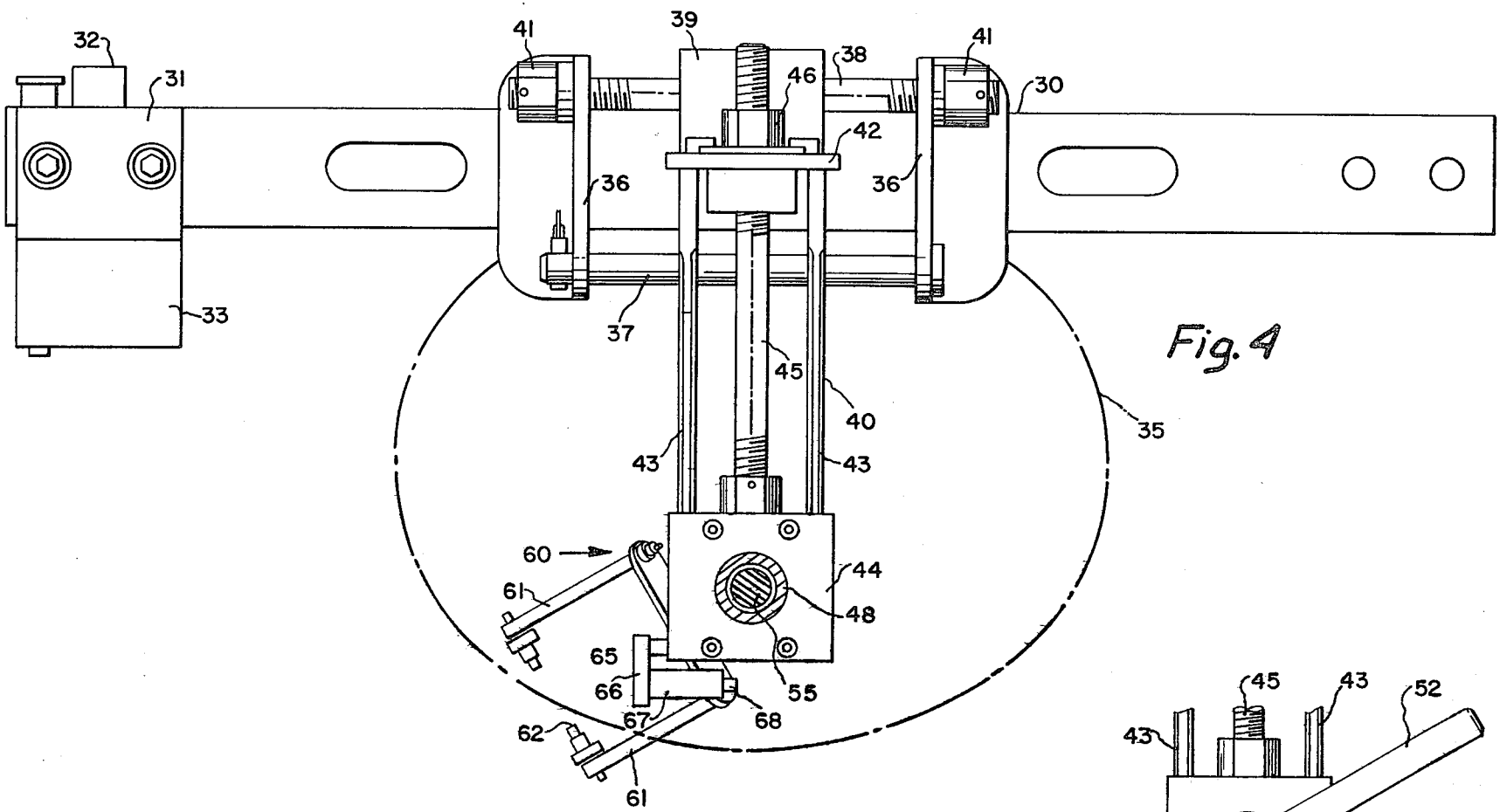
FIG. 4 is a partially sectionalized view of the second embodiment of the manway cover handling apparatus taken along the lines 4—4 in FIG. 3 and looking in the direction of the arrows.

Referring to FIGS. 3 and 4, it is seen that the therein illustrated embodiment includes a horizontal support arm 30 having a vertical journal block 31 on its left end and which is removably fitted for rotation on a vertical pivot post 32. The post 32 is supported by an arm 33 suitably affixed, as by welding, to the shell 1 of the equipment on the left side of the manway opening therein. This arrangement enables an operator to swing the arm 30, and any parts carried or supported thereby, toward and away from the shell and manway openings therein, and in a contained header, indicated by the broken-line designation 35 in FIG. 4.

A pair of vertically extending brackets 36 which support a fixed bar 37 and a rotatable externally threaded rod 38 are affixed to the support arm 30. The rod 38 cooperates with an internally threaded block 39 which comprises the upper end of a vertical slide bracket generally designated 40. The ends of the threaded rod 38 extend through the brackets 36 and are fitted with adjusting nuts 41 which can be readily turned to effect lateral movements of the threaded block 39 and thus provide for adjustments of the horizontal position of the vertical slide bracket 40 of the support arm 30. In a manner to be discussed in greater detail hereinafter, this arrangement assists an operator in obtaining precise lateral positioning of a manway cover when sealing it is position in the header thusly to ensure against leakage at the seal.

Figure 6:
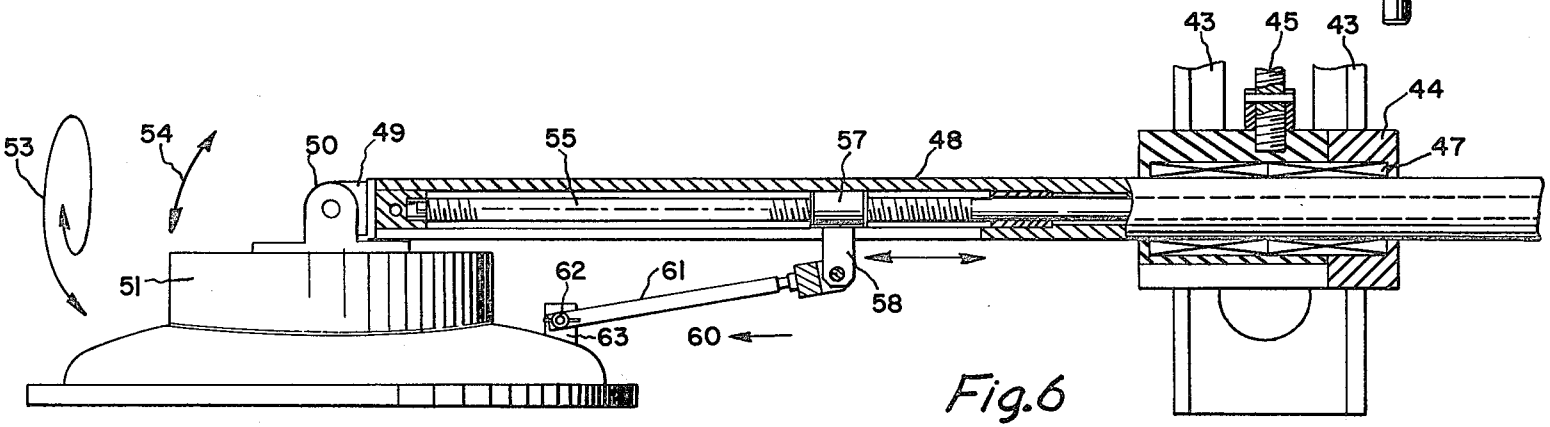
FIG. 6 is a fragmentary partially sectionalized view further illustrating the structure for, and the manner in which the apparatus is effective for both rotating and tilting an attached manway cover.

In addition to the block 39, the vertical slide bracket 40 comprises an upper end plate 42, a spaced pair of vertically extending side plates 43 and a bearing block 44. The bearing block 44 is suitably mounted between the side plates 43 for adjustable vertical positioning therebetween, and adjustments of its position is effected by an arrangement including a threaded vertical rod 45 which, as seen in FIG. 6 has its lower end suitably secured in the top of the bearing block 44. The upper end of the rod 45 passes loosely through the plate 42 and carries a nut 46 above the plate 42 which when turned is effective for adjustably moving the rod vertically whereby the bearing block 44 is adjustably positionable vertically between the side plates 43. In a manner to be described hereinafter, this arrangement assists an operator in obtaining precise vertical positioning of a manway cover when sealing it in position in the header.

As best seen in FIG. 6, the bearing block 44 houses a linear bearing 47 in which is slidably and rotatably positioned a tubular shaft 48 fitted on its inner end with an apertured cover connector 49. The connector 49 is adapted for being suitably pivotally connected or coupled to the apertured lug 50 at the center of a manway cover 51 similar to the manway cover previously described with reference to FIGS. 1 and 2.

During operation of the apparatus the tubular shaft 48 bears the load of the manway cover in a cantilever arrangement and by being slidably positionable in the bearing 47 enables an operator to move the cover horizontally toward and away from the manway opening. The overall load of the cover on the shaft is borne by the handling apparatus through the vertical slide bracket 40, the horizontal support arm 30, the pivot 32, and the arm 33 and, in turn, is transmitted to the shell 1 to which the arm 33 is affixed.

Figure 5:
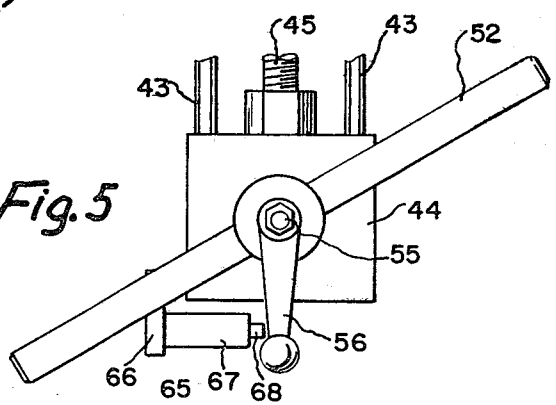
FIG. 5 is a fragmentary view illustrating the lever handle and crank handle provided to rotate, respectively, the tubular shaft and threaded rod.

A double-ended lever handle 52 is secured to the end of shaft 48 opposite cover connector 49 as is shown in FIGS. 3 and 5. The lever handle 52 is provided to enable the operator readily and easily to actuate the shaft 48 both linearly and rotationally thusly to enable the operator to rotate the cover about its central axis in the directions indicated by the double-headed arrow 53 in FIG. 6 and to position and hold the cover in the most advantageous position for insertion of an elliptical cover into the elliptical manway opening. In this operation the operator is further assisted by means enabling him to tilt the cover in the manner indicated by the double-headed arrow 54 in FIG. 6.

The tilting means comprises a threaded rod 55 rotatably retained in the shaft 48 and extending from the outer end thereof. The extending end of the rod 55 is fitted with a crank handle 56 so that the rod can be easily rotated by the operator. This rotation causes longitudinal actuation in the shaft 48 of a threaded member 57 also housed in the shaft. The member 57 carries a dependent portion 58 which extends through a longitudinal slot 59 in the tubular shaft. The slot 59 extends from the inner end of the shaft to an intermediate point and its length determines the length of possible movement of the member 57 when the rod 55 is turned with the crank handle 56. The dependent part 58 of the member 57 is apertured and is pivotally connected to a double-sided linkage generally designated 60. The linkage 60 includes a pair of spaced arms 61 which carry inwardly projecting pins 62 adapted for being removably inserted in a spaced pair of apertured lugs 63 formed in the outer surface of the manway cover adjacent the rim thereof. Thus, by selectively turning the crank handle 56 the member 58 can be actuated toward and away from the inner end of the tubular shaft. This actuation, through the pivoted linkage 60, is effective for tilting the cover in the directions indicated by the arrow 54. Such tilting capability provides the operator with another axis of rotation, namely, a transverse axis through the cover and normal to the axis of the shaft, for the cover when maneuvering it into position for insertion through the manway opening and for thereafter positioning it vertically in the header following insertion to enable it to be clamped in closed sealing position in the manner shown in FIG. 2.

Shaft 48 and the threaded rod therein, additionally, can be locked against rotation relative to the supporting structure by means of a locking device illustrated in FIGS. 3–5 and generally designated 65. This device is pivotally mounted on the block 44 and includes a pivoted vertical arm 66 supporting a horizontally extending tubular member 67 which carries a retractable locking pin or detent 68. When it is desired to lock the shaft, the arm 66 is swung into an engaging position in which the locking pin 68 is insertable into a suitable aperture provided in the shaft and against a flat portion formed on the rod and not shown.

With the use of the above-described apparatus an operator can readily and easily position an elliptical manway cover in an elliptical opening in a header and can precisely position it therein for sealing without damage to the sealing surface or any adjacent parts. More specifically, in using the apparatus, the operator would swing it about the axis of the pivot 32 and away from the shell for attaching the cover to the connector 49 and to the tilt linkage 60. Then, by swinging the apparatus toward the shell opening, rotating the shaft 48 by means of the double-ended lever handle 52, and tilting the cover by means of rotating the crank handle 56, the operator can effectively position the cover inside the header with considerable control thereover to ensure against causing damage by the heavy cover to the sealing surface 47 or other parts.

After the cover is inserted the crank handle 56 is turned to tilt the cover to the vertical position thereof shown in FIG. 2. Then the locking means 65 are operated to assist in holding the cover in the placed position. Thereafter, the slide bracket 40 is laterally adjusted by turning nuts 41 and the apparatus is vertically adjusted by turning nut 46. In this way the cover is very precisely positioned in the header for cooperation, for example, with the gasket 11 on the sealing surface 7 shown in FIG. 2, and the clamping arrangement 12 or other cover securing means is used effectively to draw the cover outwardly into its closed sealed position. With the cover in sealing position the handling apparatus can be detached or uncoupled and swung out of position until needed again or, alternatively, the apparatus can be lifted from the post 32 and mounted on another post provided adjacent another opening in the shell and header where the aid of the apparatus may be needed in positioning or removing a manway cover.

While to this point the operation of the described apparatus has been described with respect to the installation of a manway cover, it is to be understood that the apparatus may be utilized for removing manway covers. The removing operation is essentially the reverse of the installing operation. Additionally, while specific embodiments of the present invention have been shown and described it is to be understood further that the present invention is not limited to the particular forms shown and described, and it is intended by the appended claims to cover all modifications within the spirit and scope of the present invention.

What is claimed is:

1. Apparatus for handling elliptical manway covers and the like for sealable tanks and shells and located interior thereof comprising:

(a) a support arm;

(b) means for pivotally mounting one end of said support arm on the exterior of the tank or shell adjacent a manway opening therein adapted to receive an internal cover and whereby said arm may be swung horizontally inwardly inboard of said opening;

(c) a shaft slidably movable and rotatable along its longitudinal axis, and lineary adjustable vertically and horizontally relative to said support arm;

(d) means for pivotally coupling one end of said shaft to the center of a cover interior of said opening;

(e) means for actuating said shaft linearly for inserting said cover into and removing said cover from said opening by motion inwardly of said opening; and (f) means for rotating said shaft to enable rotation of said cover about the axis of said shaft interior of said opening during insertion and removal operations.

2. Apparatus according to claim 1 and further comprising means for rotating said cover about an axis perpendicular to the axis of said shaft to enable tilting of said cover within said opening during insertion and removal operations.

3. Apparatus according to claim 1, wherein said shaft is mounted in a linear bearing supported in a bracket adjustably positionable on said arm.

4. Apparatus according to claim 1, wherein said shaft is mounted in a linear bearing supported in a bearing block supported by, and vertically adjustably positionable relative to, said arm.

5. Apparatus according to claim 1, wherein a double-ended lever is secured to said shaft at its other end thereby to facilitate manual longitudinal actuation and rotation of said shaft.

6. Apparatus according to claim 1, wherein said shaft is tubular and contains a rotatable threaded rod and a threaded member carried on said rod and longitudinally actuatable in said shaft upon rotation of said rod, and said threaded member is pivotally linkable to said cover adjacent its rim whereby said cover is tiltable upon actuation of said threaded member.

7. Apparatus according to claim 6, wherein a crank handle is secured to an end of said rod protruding from said shaft thereby to facilitate manual rotation of said rod.

8. Apparatus according to claim 6, wherein said shaft includes a longitudinally extending slot, and said threaded member includes an extension protruding through said slot and being pivotally linked to said cover.

9. Apparatus according to claim 1, further comprising a vertical slide bracket supported by, and laterally adjustably positionable on, said arm; and a bearing block supporting said shaft and being vertically adjustably positionable relative to said slide bracket.

10. Apparatus for handling elliptical manway covers and the like for sealable tanks and shells comprising:

(a) a support arm;

(b) means for pivotally mounting one end of said support arm on equipment adjacent an elliptical manway opening therein whereby said arm may be swung horizontally relative to said opening;

(c) a vertical slide bracket supported by, and laterally adjustably positionable on, said arm;

(d) a bearing block slidably supported by, and vertically adjustably positionable in, said slide bracket;

(e) a linear bearing positioned in said bearing block;

(f) a tubular shaft mounted in said linear bearing and having a longitudinally extending slot;

(g) means for pivotally coupling one end of said shaft to the center of a cover;

(h) a double-ended lever handle secured to the other end of said shaft for actuating the shaft linearly and for rotating the shaft to enable rotation of said cover about the central axis thereof;

(i) a threaded rod concentrically and rotatably retained in said shaft;

(j) a threaded member positioned in said shaft on said rod and having a depending portion extending through said slot in said shaft;

(k) means for pivotally linking said depending portion of said threaded member to said cover adjacent its rim and effective for tilting said cover about a transverse axis thereof when said threaded member is actuated longitudinally in said shaft; and (l) a crank handle on an end of said rod protruding from said shaft for rotating said rod to actuate said threaded member.

11. Apparatus according to claim 10 further comprising locking means carried by said bearing block and releasably engageable with said shaft and threaded for securing said shaft and rod against movement relative to said slide bracket.

* * * * *